US006857248B2

(12) United States Patent
Ouellet et al.

(10) Patent No.: US 6,857,248 B2
(45) Date of Patent: Feb. 22, 2005

(54) PANEL, A KIT AND A METHOD FOR FORMING A MASONRY WALL

(75) Inventors: André Ouellet, Magog (CA); Michel Bouchard, Montreal (CA)

(73) Assignee: Les Materiaux de'Construction Oldcastle Canada Inc., St. John - NB (CA)

( * ) Notice: Subject to any disclaimer, the term of this patent is extended or adjusted under 35 U.S.C. 154(b) by 0 days.

(21) Appl. No.: 10/153,928

(22) Filed: May 23, 2002

(65) Prior Publication Data

US 2002/0174622 A1 Nov. 28, 2002

Related U.S. Application Data

(60) Provisional application No. 60/293,236, filed on May 24, 2001.

(51) Int. Cl.[7] ..... E04B 1/00; E04G 21/00; E04G 23/00

(52) U.S. Cl. ..... 52/745.06; 52/749.11; 52/387; 52/302.3; 52/169.5; 249/96; 249/15; 249/141

(58) Field of Search ..... 52/745.06, 749.11, 52/386, 387, 315, 302.1, 302.3, 169.5; 249/96, 15, 141

(56) References Cited

U.S. PATENT DOCUMENTS

| | | | | | |
|---|---|---|---|---|---|
| 2,339,489 | A | | 1/1944 | Kublanow | |
| 2,964,800 | A | * | 12/1960 | Dorsett | 264/112 |
| 3,238,598 | A | | 3/1966 | McClarney | |
| 3,350,827 | A | | 11/1967 | Sugar | |
| 3,496,694 | A | | 2/1970 | Hicks et al. | |
| 3,602,476 | A | * | 8/1971 | Iragorri | 249/96 |
| 3,712,825 | A | | 1/1973 | Yocum | |
| 3,868,801 | A | * | 3/1975 | Weiner | 52/309.5 |
| 3,908,326 | A | * | 9/1975 | Francis | 52/384 |
| 4,510,729 | A | | 4/1985 | Syring | |
| 4,589,241 | A | | 5/1986 | Volpenhein | |
| 4,656,722 | A | | 4/1987 | Armstrong | |
| 4,858,410 | A | * | 8/1989 | Goldman | 52/591.5 |
| 5,009,387 | A | | 4/1991 | Scott et al. | |
| 5,232,608 | A | | 8/1993 | Mayer | |
| 5,268,137 | A | * | 12/1993 | Scott et al. | 264/225 |
| 5,386,963 | A | | 2/1995 | Nasvik et al. | |
| 5,459,938 | A | | 10/1995 | Knight et al. | |
| 5,501,049 | A | | 3/1996 | Francis et al. | |
| RE35,380 | E | | 11/1996 | Rea et al. | |
| 5,632,922 | A | | 5/1997 | Nasvik et al. | |
| 5,839,251 | A | | 11/1998 | Weinstein | |
| 5,855,075 | A | | 1/1999 | DiGiovanni | |
| 5,894,676 | A | | 4/1999 | DiGiovanni | |
| 6,041,567 | A | | 3/2000 | Passeno | |
| 6,164,037 | A | | 12/2000 | Passeno | |
| 6,360,505 | B1 | * | 3/2002 | Johns | 52/311.1 |

* cited by examiner

*Primary Examiner*—Carl D. Friedman
*Assistant Examiner*—Chi Q. Nguyen
(74) *Attorney, Agent, or Firm*—Dinsmore & Shohl LLP

(57) ABSTRACT

A panel for forming a masonry wall on a building surface, comprising a back face for covering the building surface, opposite edges and a front face with a predetermined pattern of first and second depressions. The first depressions are shaped and sized for receiving masonry pieces as a whole whereas the second depressions, which intersect the opposite edges, are shaped and sized for receiving parts of masonry pieces, so that, when the panel is mounted side by side with a complementary panel, some masonry pieces bridge both panels by means of the second depressions. The panel makes it possible for an unskilled worker to build relatively rapidly a masonry work having a complex predetermined pattern of masonry pieces. Thanks to the second depressions that make it possible for some pieces of masonry to bridge panels mounted side by side, the general arrangement of pieces, when completed does not look like a series of individual panels but rather look continuous.

26 Claims, 11 Drawing Sheets

PANEL, A KIT AND A METHOD FOR FORMING A MASONRY WALL

FIELD OF THE INVENTION

This invention relates generally to the field of masonry works and installations. More particularly, it concerns a panel and a method for forming a masonry wall having a predetermined pattern of stonework or brickwork.

BACKGROUND OF THE INVENTION

Stone masonry and brick masonry facings have been traditionally constructed by skilled workers from individual units, such as bricks, stones, or rocks, set and mortared one after the other into the shape of a wall. This is a very long process which is time consuming, and that, even more for a stone work which involves the assembling of a plurality of different shapes and sizes of pieces of stone.

Current methods use wire mesh affixed to a back panel upon which an adhesive cement is applied followed by the stone or brick elements. Other methods use specially designed long pieces of extruded or bent and folded metal to act as rectilinear support structure upon which stone work is applied. Further methods employ mortarless bricks, which rely upon the nailing or screwing of pieces of thin, regularly spaced, strips of wood onto which rows upon rows of bricks are nailed down.

Different solutions have been proposed in the prior art for reducing the time required for forming or designing a masonry wall, especially a stone work, or for making its construction available to an unskilled person.

Among these prior art solutions, there are the prefabricated artificial facings which consist of panels or form liners with an assemblage of decorative prefabricated molded bricks or stones giving the appearance of natural brick, stone or other masonry material. These pre-fabricated panels or liners have to be transported to the job site to be attached to the frame of a building. One drawback encounters with many of these prefabricated artificial facings is that they often do not provide an architecturally satisfactory appearance of real brick or stone. Also, they are often very heavy and are thus difficult and cumbersome to transport to the job site and to install on the building structure. Another drawback with many of these pre-fabricated panels is that once installed side by side on a surface, the separation line between the panels is clearly visible which makes those prefabricated panels less attractive for someone researching the appearance of a real natural stonework. Examples of such prior art prefabricated facings are giving in U.S. Pat Nos. 2,339,489; 3,496,694; 3,350,827; 3,712,825; 3,908,326; 4,510,729; 4,656,722; 5,386,963; 5,632,922; 6,041,567; and 6,164,037.

Also known in the prior art, there are U.S. Pat. Nos. 5,855,075 and 5,894,676, which disclose a brick template for laying a plurality of bricks. This template, which serves as a guide for mounting the rows of bricks, includes a planar and rigid sheet having a plurality of support pins projecting therefrom in a predetermined pattern for supporting a plurality of bricks.

Further known in the prior art, there is U.S. Pat. No. 5,009,387 which discloses a liner made of an elastomeric material with recesses formed therein for receiving bricks. Retaining devices attached to the liner are provided for retaining the pieces of brick into the recesses.

U.S. Pat. No. 5,839,251 discloses a masonry construction aid which allows its user to insert masonry into a predetermined, pre-formed, soluble pattern that contains within a bonding material. After applying a catalyst to the pattern, the pattern disintegrates, the bonding agent activates and bonds the masonry together and hardens into a permanent structure. The pattern disclosed therein is devised to form a non complex masonry work with respect to the arrangement of the bricks on the wall.

U.S. Pat. No. 5,501,049 discloses a thin brick panel assembly for forming a brick facing on a building structure. The brick panel assembly includes a backing member with a generally uniform cross-section throughout its entire length, providing channels, which allow the thin brick, tiles to lay uniformly across each row. The channels are defined by retaining bars which hold the thin brick tiles in place. The retaining bars include mortar lock notches, which are adapted to provide a dovetail connection between the mortar and the backing board, and a path for moisture and water to escape from the brick panel assembly. This brick panel assembly is specifically adapted for mounting masonry pieces having a regular rectangular shape.

Other examples of prior art systems are disclosed in U.S. Pat No. 3,238,589; U.S. Pat. No. RE 35,380; U.S. Pat. Nos. 5,459,938 and 5,232,608.

Although many efforts have been made in the prior art to provide devices or systems aiming at facilitating the construction of masonry work, there is still a need for a device or system that will allow professional, and also unskilled persons, to rapidly and easily construct a masonry work having the look of a traditional masonry work made by highly skilled artisan.

SUMMARY OF THE INVENTION

An object of the present invention is to provide a panel and a method that satisfy the above-mentioned need.

Accordingly, the present invention proposes a panel for forming a masonry wall on a building surface. The panel comprises a back face for covering the building surface, opposite edges and a front face with a predetermined pattern of first and second depressions. The first depressions are shaped and sized for receiving masonry pieces as a whole whereas the second depressions, which intersect the opposite edges, are shaped and sized for receiving parts of masonry pieces, so that, when the panel is mounted side by side with another panel, some masonry pieces bridge both panels by means of the second depressions. The opposite edges comprise a right edge and a left edge and preferably each of the second depressions intersecting the right edge is complementary with a corresponding one of the second depressions intersecting the left edge so that when the panel is mounted side by side with another like panel, some masonry pieces bridge the left and right edges of the panels by means of the second depressions, which intersect the left and right edges. The opposite edges comprise also a top edge and a bottom edge and preferably each of the second depressions intersecting the top edge is complementary with a corresponding one of the second depressions intersecting the bottom edge so that when the panel is mounted on top or underneath another like panel, some masonry pieces bridge the top and bottom edges of the panels by means of the second depressions, which intersect the top and bottom edges.

In accordance with a preferred embodiment of the invention, the second depressions are positioned along the right edge and the left edge of the panel such that the right edge and the left edge of the panel are matable with the left edge and the right edge respectively of another like panel as the bottom edge of said another like panel is set out of line with the bottom edge of the panel.

A panel according to the present invention makes it possible for an unskilled worker to build relatively rapidly a masonry work having a complex predetermined pattern of masonry pieces. Thanks to the second depressions that make it possible for some pieces of masonry to bridge panels mounted side by side, the general arrangement of pieces, when completed does not look like a series of individual panels but rather look continuous.

According to another aspect of the invention, there is provided a method for forming a masonry wall on a building surface, the method comprising the steps of:

a) mounting side by side on the building surface a plurality of panels as defined above such that the second depressions of each panel are mated with their corresponding second depressions from an adjacent panel;

b) inserting in each of the first and second depressions a piece of masonry as a whole;

c) mortaring the pieces of masonry.

Preferably, step a) of mounting comprises the step of screwing each panel to the building surface.

Also preferably, the method comprises the step of anchoring the mortared pieces of masonry to the building surface. The step of anchoring preferably comprises, prior to step c) of mortaring, the step of:

inserting a fastener including first and second opposite ends through a number of ridges outlining the first and second depressions. The fasteners are inserted in such a manner that the first end thereof is anchored into the building surface and the second end is jutting out of the respective ridge thereby causing the second end to be covered with mortar in step c).

The invention also proposes a kit for forming a masonry wall on a building structure. The kit comprises:

a set of masonry pieces, each masonry piece having a given shape and size;

a set of panels as defined above, each panel of the set having at least one complementary panel in the set so that when a panel of the set is mounted side by side with its complementary panel, some masonry pieces bridge both panels by means of the second depressions.

BRIEF DESCRIPTION OF THE DRAWINGS

Other objects and advantages of the invention will become apparent upon reading the detailed description and upon referring to the drawings in which.

Figure 1:
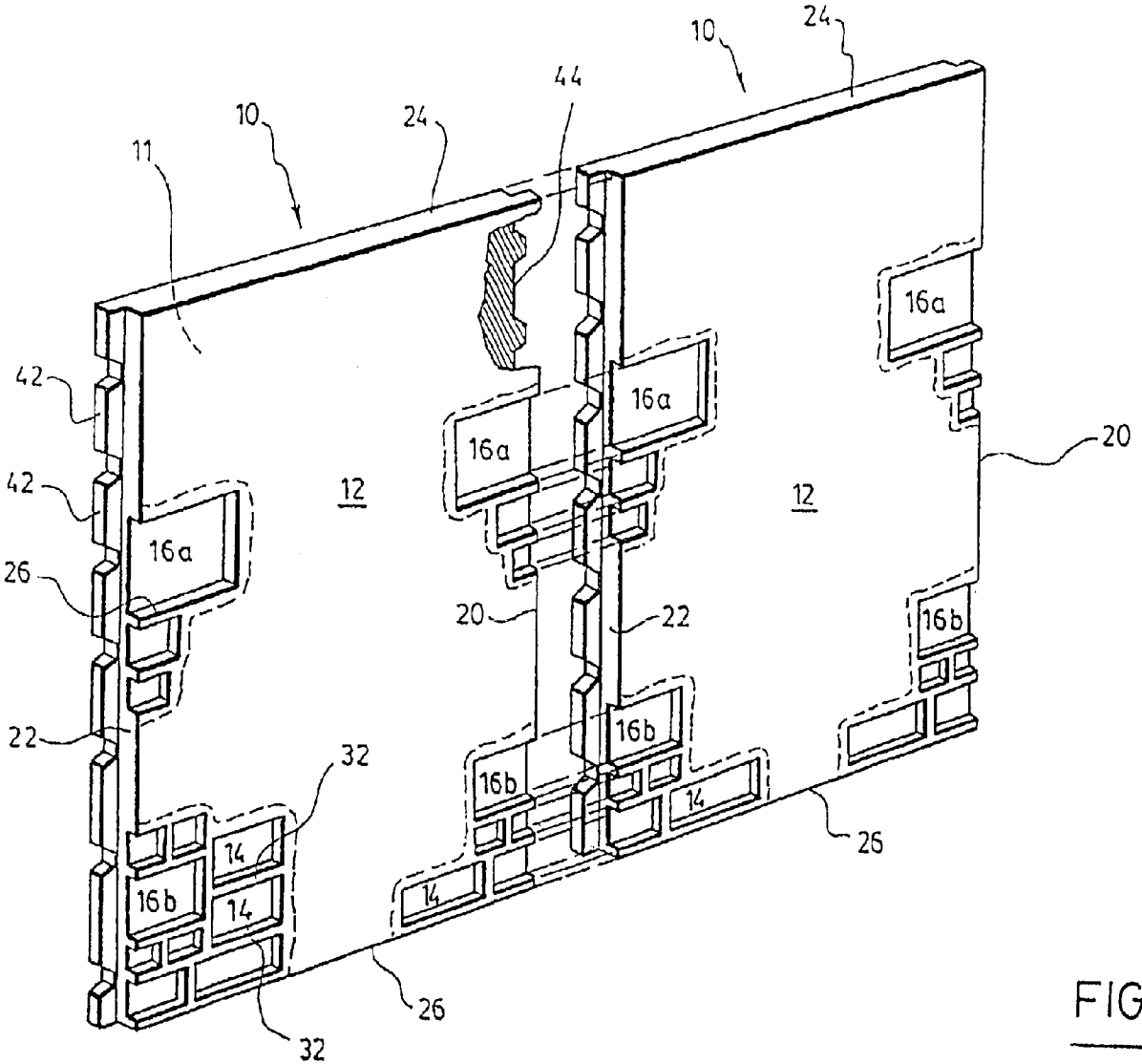
FIG. 1 is a perspective view of two identical panels according to a first preferred embodiment of the invention, about to be connected together.

While the invention will be described in conjunction with example embodiments, it will be understood that it is not intended to limit the scope of the invention to such embodiments. On the contrary, it is intended to cover all alternatives, modifications and equivalents as may be included as defined by the appended claims.

DESCRIPTION OF PREFERRED EMBODIMENTS

In the following description, similar features in the drawings have been given similar reference numerals and in order to weight down the figures, some elements are not referred to in some figures if they were already identified in a precedent figure.

Figure 2:
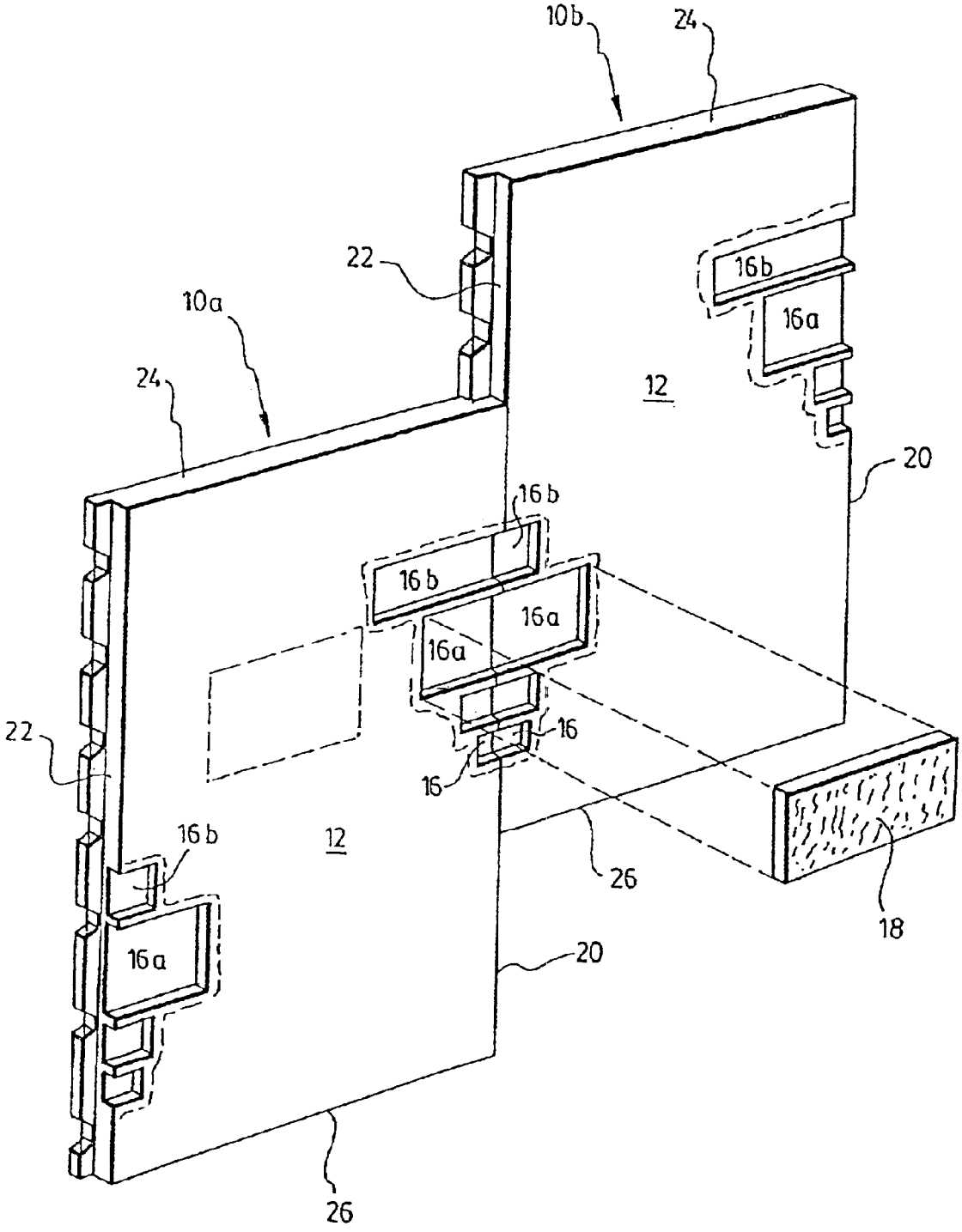
FIG. 2 is a perspective view of two identical panels according to a second preferred embodiment of the invention already connected together and with a stone about to be installed in one of the second depression bridging both panels.

Referring to FIGS. 1 or 2, panels (10) according to two different preferred embodiments of the present invention are illustrated. Both these panels (10), have in common that they comprise a back face (11) for covering the building surface and a front face (12) with a predetermined pattern of first and second depressions (14,16). By depressions, it is meant areas on the front face that are sunk below their surrounding. The first depressions (14) define cells shaped and sized for receiving entire masonry pieces (18) as a whole, as shown for example in FIG. 6, whereas the second depressions (16) intersect opposite edges (20,22,24,26) of the panel (10), meaning that the second depressions (16) cross these edges (20, 22, 24,26). The second depressions (16) are shaped and sized for receiving parts of masonry pieces (18), so that, when the panel (10) is mounted side by side with another panel (10), as in FIG. 2, some masonry pieces (18) bridge both panels (10) by means of the second depressions (16). In order not to unnecessarily overload the FIGURE only one piece of masonry (18) is illustrated in FIG. 2.

The panel (10) is preferably made of an insulating material, more preferably it is made of foam such as a polystyrene foam. Another advantage of the panel (10), in such a case, is that it can be use to insulate the building without requiring other insulation means. It is however important to note that the present invention is not limited to panels made of foam. In fact, a panel according to the invention could be made of any material sufficiently rigid to support the pieces of masonry (18). The choice of material used to make the panel could thus be made in function of the weight of the pieces of masonry. For example, if the pieces of masonry are artificial stones made of a light concrete and/or plastic composite, the material used to build the panel will not need to be as rigid as if real natural stones would be used. As apparent to any person skilled in the art, a panel according to the invention could thus be made of any material sufficiently rigid to support the pieces of masonry. Examples of suitable material are plastic foam, rigid plastic, composite made of cement and wood chips, composite made of mesh and plastic, etc.

Preferably, the depressions (14,16) are pre-cut in the panel or premolded as the panel is being molded. They are shaped to fit custom cut pieces of masonry (18) either, bricks, natural stones, precast concrete simile-stones or masonry pieces made of plastic. The depressions (14,16) may have a symmetrical shape, for example rectangular, or an irregular shape to fit the natural curved outline of a stone. More preferably, the pieces of masonry (18) are precast concrete simile-stones having predetermined shapes and sizes.

A panel (10) according to the invention is preferably rectangular. It either defines a square or a rectangular with a height greater than its width as shown in the figures. However, it is worth mentioning that the present invention also contemplates using panel having other shapes such as triangular, parallelogram, trapezoid etc. so long as it comprises second depressions (16) as described above.

In the case where a panel (10) according to the invention is also used for insulating a building, the thickness of the backing of the panel will be chosen according to the degree of insulation required. However, in the case where the panel is used solely for forming the masonry wall, the thickness of the backing is not critical and could be very thin as a sheet.

Figure 4:
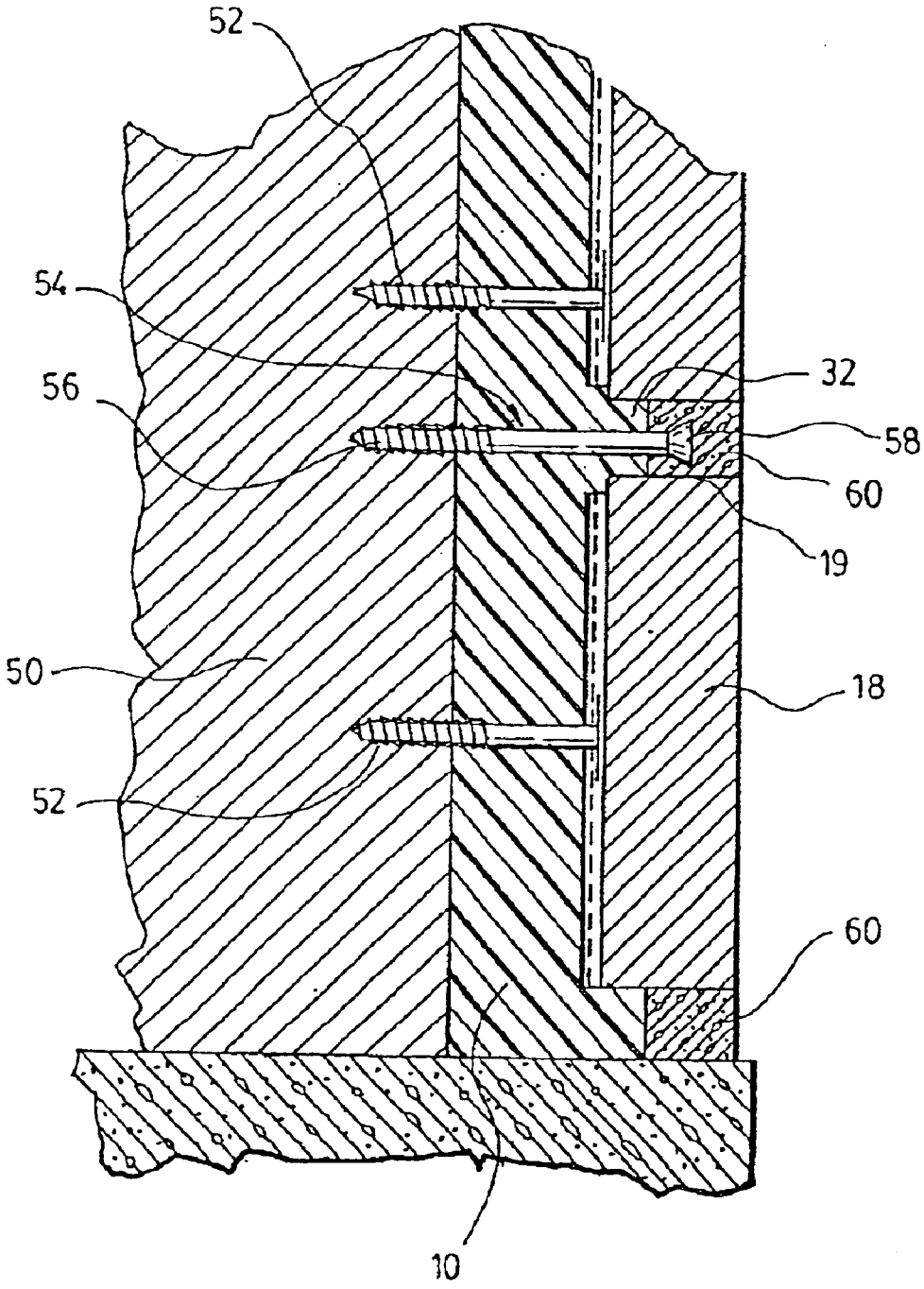
FIG. 4 is a cross-sectional along line IV—IV of FIG. 3.

The first and second depressions (14,16) preferably have a depth predetermined in function of the thickness of the masonry pieces to be received therein. As shown in FIG. 4, such depth is chosen to be less than the thickness of the masonry pieces (18), so as to allow mortar to be applied between inserted masonry pieces (18).

The panel (10) also preferably comprises retainer to retain temporarily the pieces of masonry (18) within the first and second depressions (14,16) before those pieces (18) have been bound together with the mortar. The retaining means could be a bonding mixture, such as an adhesive mixture of cement that can be applied into each of the depressions (14,16), and then a stone is pressed in.

Figure 5:
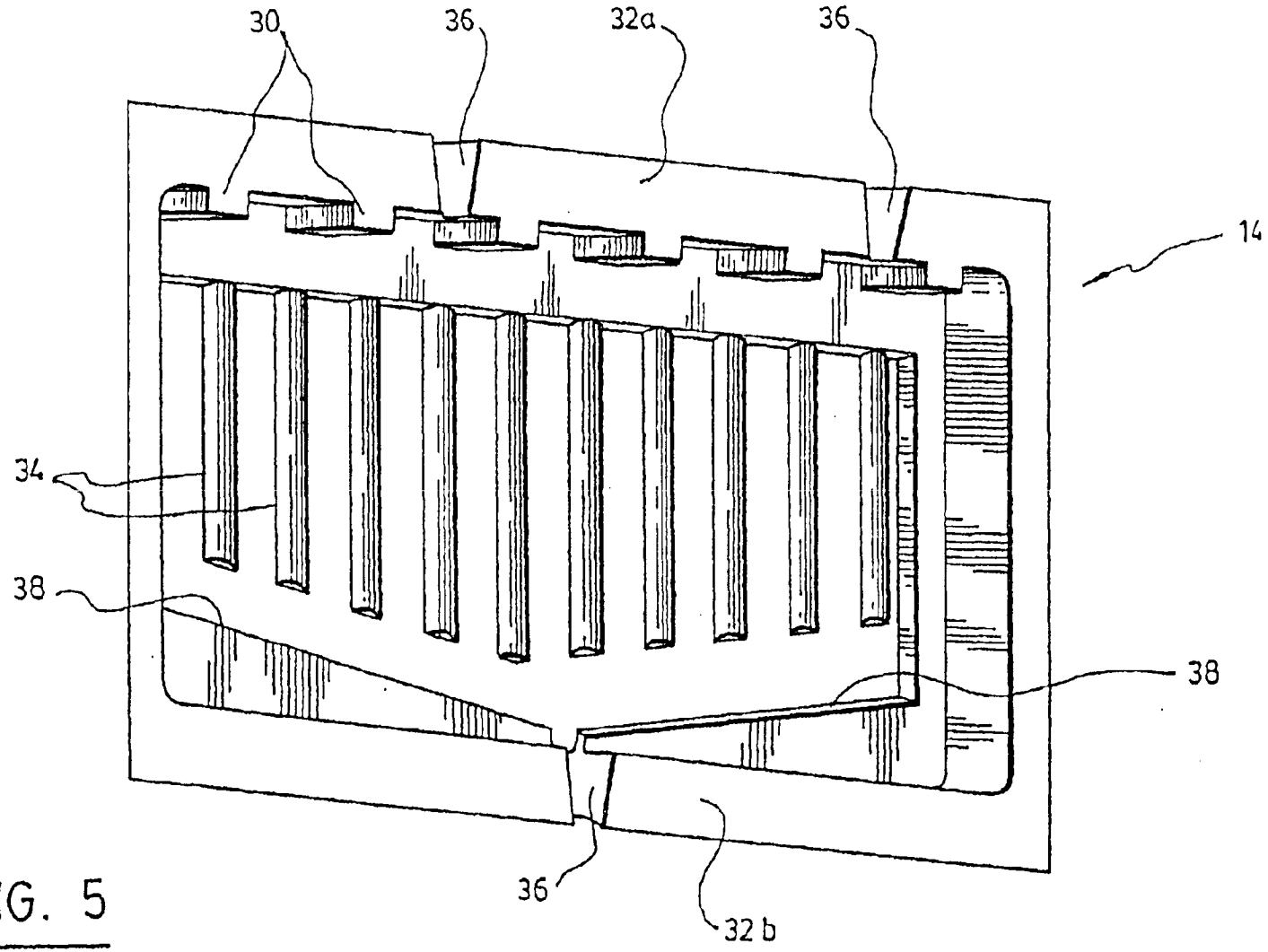
FIG. 5 is a perspective view showing an example of a single depression located for instance in the rectangular area indicated by the dotted lines in FIG. 2. This view shows the retainer to temporarily retain a piece of masonry therein and the draining means for draining water seeping between the panel and the masonry pieces.

In reference to FIGS. 1, 2 and 5, the retaining means may preferably comprise projections (30) made of a resilient material projecting from the ridges (32) outlining the first and second depressions (14,16). As best shown in FIG. 5, the projections (30) are preferably projecting from a top ridge (32*a*) of each depression (14,16). When a piece of masonry (18) is inserted into a depression, the projections (30) are first compressed, and then, they return to their original shape thereby holding the piece (18) tight by squeezing it. These projections (30) are formed during the cutting or the molding of the depressions (14,16).

Further preferably, each piece of masonry (18) comprises a top edge (19) including projections (not illustrated) adapted to cooperate with the projections (30) of the depressions (14,16). The projections of the masonry pieces (18) could be made with pieces of wood or other material bonded to the top edge (19) of the piece (18). It could also be integral to the piece (18) and molded with the same.

Figure 9:
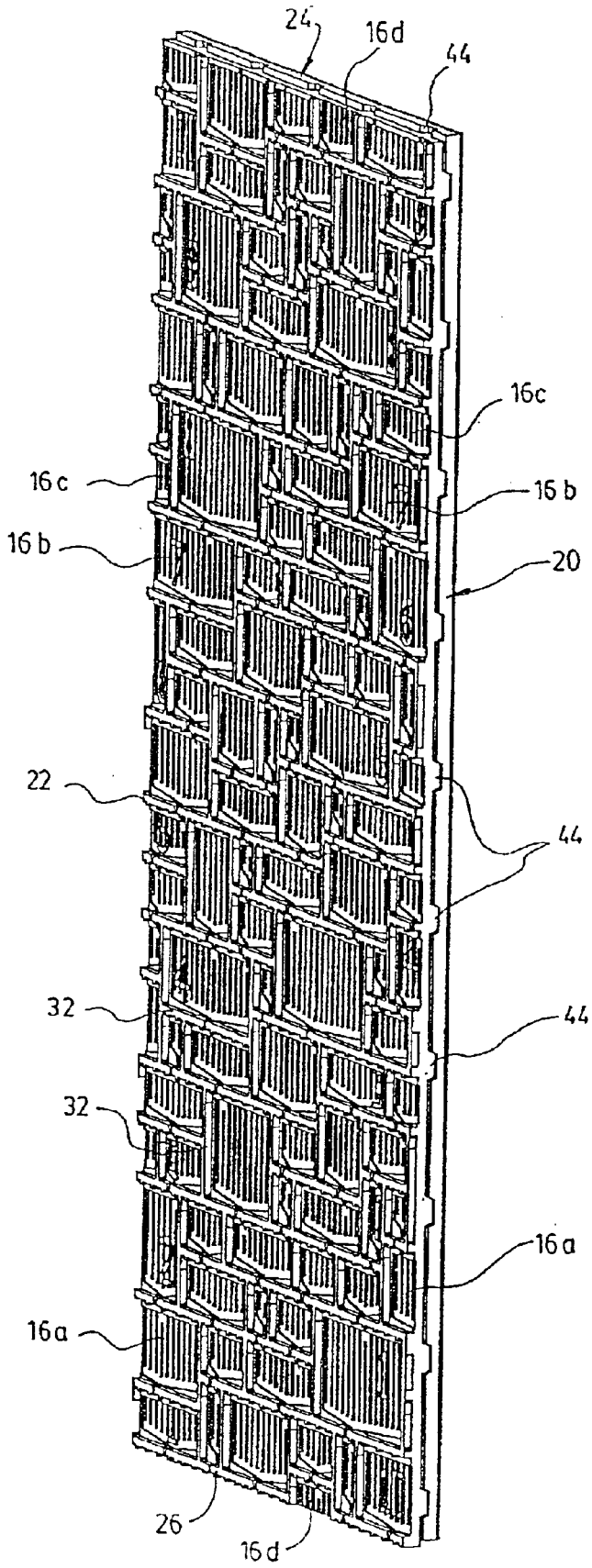
FIG. 9 is a front perspective view of a panel according to a third preferred embodiment of the invention.

The panel (10) also preferably comprises draining means for draining liquid seeping between installed pieces of masonry (18) and the panel (10). The draining means may comprise at least one groove (34), preferably a plurality, formed in a bottom face of the first and second depressions (14,16) and at least one cut (36) made in the ridges (32). These grooves (34) and cuts (36) extend in a direction allowing a liquid seeping between installed pieces of masonry (18) and the panel (10) to flow downwards into a passage formed by the grooves (34) and the cuts (36). Preferably, as shown in FIGS. 5 and 9, the grooves (34) and cuts (36) are parallel to the right and left edges (20,22) of the panel (10).

Also preferably, the bottom ridge (32*b*) of each depression (14,16) has an angled floor (38) adapted to direct the water towards the cut (36) made in the bottom ridge (32*b*).

Thanks to the predetermined pattern of depressions (14, 16) than can be traced in advance according to a well-thought out design, a panel (10) according to the invention makes it possible for an unskilled worker to execute complex masonry work, like complex brickwork and even more complex stonework. Also, the second depressions (16) positioned along the edges (20, 22, 24, 26) of the panel (10) allow the pieces of masonry (18) inserted therein to overlap two panels (10) mounted side by side, and thus to hide the joint between those panels. The general arrangement of stones, when completed, as in FIG. 3, does not look like a series of individual panels but rather, does look continuous as in traditional stonework made by highly skilled artisan.

A further advantage of the panel (10), which is made of an insulating material, is that it can also serve as the main insulating means of the building.

Figure 7:
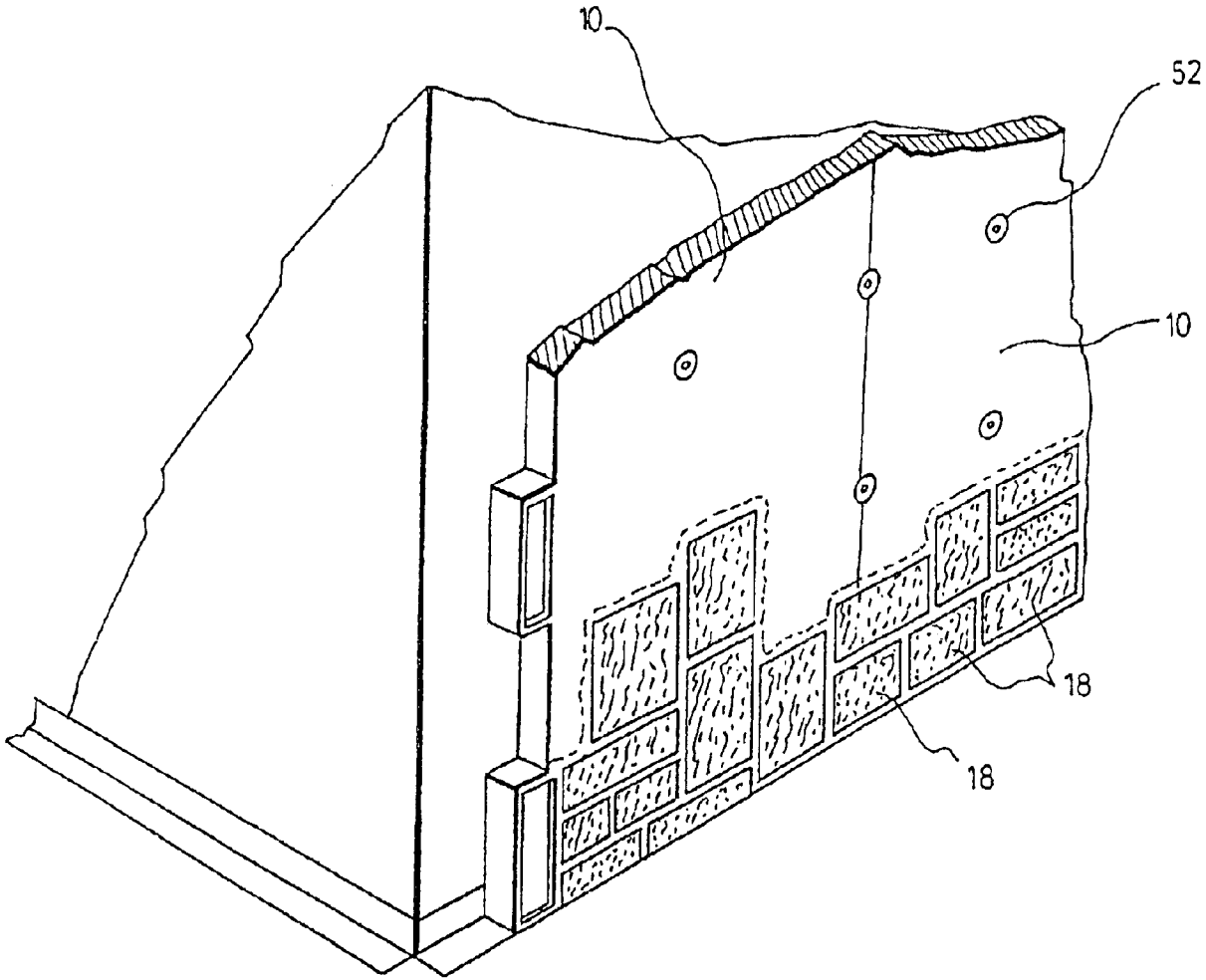
FIG. 7 is a perspective view showing a section of a wall with the two panels of FIG. 6 installed and some of the stones installed.
Figure 8:
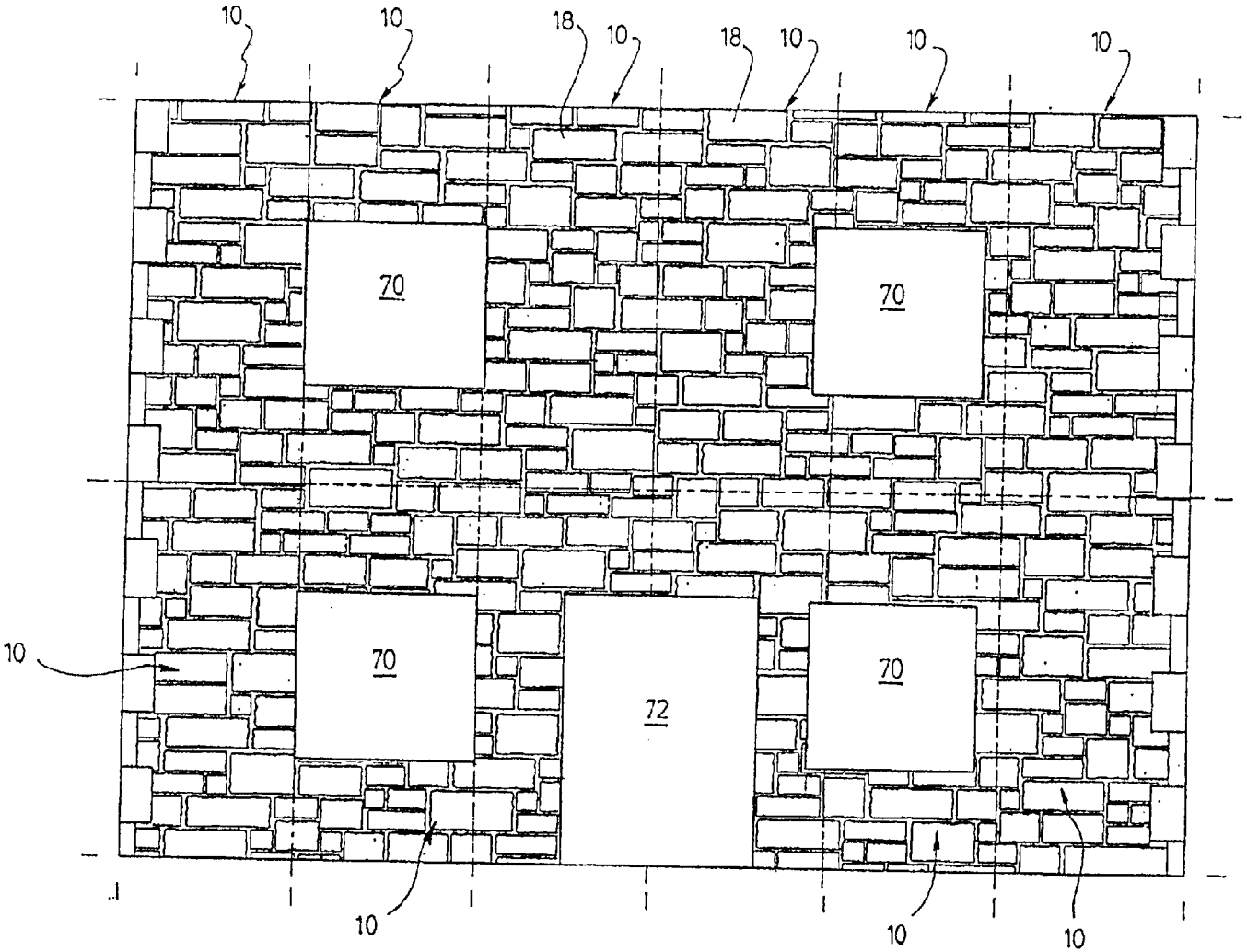
FIG. 8 is a front elevation of a house with the sequence of panels from the set of panels of FIG. 7 installed.

A masonry wall can be formed by using a set of identical panels matching each other, as shown in FIGS. 1 to 3, and 9 to 11 or it could be formed by using a set of different panels matching each other, as in FIGS. 7 to 9.

In the case of identical panels (10), and referring more specifically to FIGS. 1, 2 and 9, the opposite edges (20, 22, 24, 26) of the panel (10), which is preferably rectangular, comprise a right edge (20), a left edge (22), a top edge (24) and a bottom edge (26). In such a case, each of the second depressions (16) intersecting the right edge (20) is complementary with a corresponding one of the second depressions (16) intersecting the left edge (22) so that when a first panel (10) is mounted side by side with an identical second panel (10), some masonry pieces bridge the left and right edge (20, 22) of these panels (10). For example, in FIG. 1, 2 and 9, second depression (16*a*) appearing on the left edge (22) is complementary with second depression (16*a*) appearing on the right edge (20), and second depression (16*b*) on the left edge (22) is complementary with second depression (16*b*) on the right edge (20) and so on. Also preferably, each of the second depressions (16) intersecting the top edge (24) is complementary with a corresponding one of the second depressions (16) intersecting the bottom edge (26) so that when the first panel (10) is mounted on top or underneath the identical second panel (10), some masonry pieces bridge the top and bottom edges (24, 26) of these panels (10). For example, and referring to FIG. 9, second depressions (16*d*) appearing on the top edge (24) is complementary with the second depression (16*d*) appearing on the bottom edge (26). This preferred embodiment of the invention which uses a set of identical panels makes the construction of the masonry work even more easy by avoiding the puzzling out of the panels (10) to be mounted on the building surface. The worker simply has to mount the panels (10) one after the other on the building structure without having to choose among a set of different panels (10). The use of a set of identical panels (10) also reduces greatly the risk of error in mounting the panels (10).

According to a still further preferred aspect of the invention, the panels (10) are matchable to each other in a staggery fashion. Examples of such preferred embodiment are shown in FIG. 2 and 9. In this case, the second depressions (16) are positioned along the right edge (20) and the left edge (22) of the panel (10) such that when said panel (identified with numeral reference 10*a* in FIG. 2) is mounted side by side with a second identical panel, (identified as 10*b* in FIG. 2), the right edge (20) and left edge (22) of the first panel (10) are matable with the left edge (22) and right edge (20) respectively of the second identical panel (10*b*) as the bottom edge (26) of the second panel (10*b*) is set out of line with the bottom edge (26) of the first panel (10). Preferably, the position of the second depressions (16) along the right and left edges (20, 22) is such that the panels (10, 10*b*) are matable with each other as their bottom edges (26) are set at more than zero inch to half the height (h/2) of the panels (10), in inches, over or below each other, more preferably ten inches. This embodiment makes it possible to form a stonework which looks even more like a traditional stonework.

In order to facilitate the matching of complementary panels (10) together, the panel (10) preferably comprises a reference mark to guide the mounting of the panel (10) side by side with another like panel (10) so that the complementary second depressions (16) match each other. Turning back to FIGS. 1, 2, 9 or 10, the reference mark preferably comprises male and female members (42, 44) provided on either the right (20) or left edge (22) of the panel (10), adapted to fit together with the female and male members respectively of another like panel (10). It is worth mentioning that any other reference mark, like imprints, as in FIGS. 10 and 11, made on the back or front face of the panel can be used. In the case of the panel (10) shown in FIGS. 9 to 11, the numbers imprinted on the back face 11 provide a first reference mark for approximately matching the complementary depressions (16), whereas the male and female members (42,44) provide a reference mark to precisely match the complementary depressions (16).

Although a panel (10) according to the invention could be of any size, a panel (10) of eight feet high and four feet wide is believed to be adequate size if the panel (10) is used for the construction of a masonry wall on a residential building. The depressions (14, 16) preferably comprise a variety of predetenmined shapes and sizes adapted to receive rectangular stones having one of the following surface areas:(8 inches×16 inches), (8 inches×12 inches), (8 inches×8 inches), (6 inches×16 inches), (6 inches×12 inches), (6 inches×8 inches), (4 inches×12 inches), (4 inches×8 inches) (4 inches×4 inches) in the American system; or the equivalents in the metric system: (18.92 cm×38.4 cm); (18.92 cm×28.68 cm); (18.92 cm×18.52 cm); (14.19 cm×28.68 cm); (14.19 cm×28.68 cm); (14.19 cm×18.52 cm); (8.76 cm×28.63 cm); (8.76 cm×28.68 cm); (8.76 cm×28.52 cm); (8.76 cm×8.76 cm).

Figure 3:
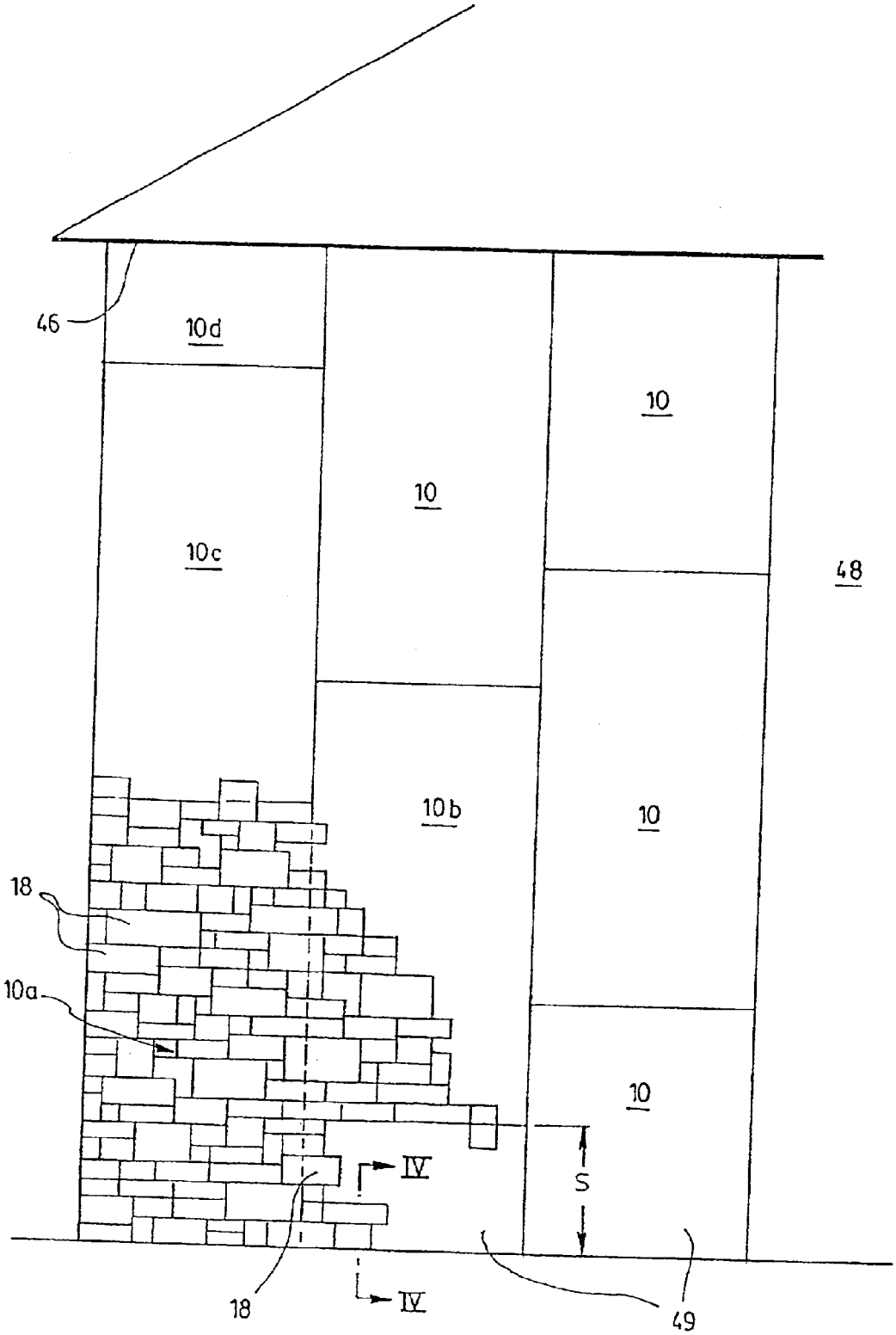
FIG. 3 is a front elevation view of a portion of a building surface showing the construction of a masonry wall by means of panels according to the invention.

A stonework under construction and executed with the panels of FIG. 2 is shown in FIG. 3. In the preferred embodiment illustrated, the step to match the panels (10) side by side is ten inches. Thus, a first panel (10*a*) is mounted and secured to the building surface (48). A second panel (10*b*) is then mounted next to the first panel (10*a*) with a step (s) of ten inches above the same, and a third panel (10*c*) is mounted on top of the first panel (10*a*). Other panels are mounted on top of the third panel (10*c*) until the upper end (46) of the building surface (48) is reached. Then, if a portion (49) of the topmost panel (10*d*) is outreaching the upper end (46) of the building surface (48), this portion is cut and can be used later on to fill an uncovered surface extending below the panels (10) already mounted. For example, a portion (49) of a panel (10) having a height of ten inches is mounted under the second panel (10*b*) and next to the lower portion of the first panel (10*a*), and so on with the other panels (10) and portions (49) of panel until the whole building surface (48) is fully covered.

Once all the panels (10) are secured to the building surface (48), the appropriate pieces of masonry (18) are inserted into the depressions (14,16) and mortared together by means of any of various bonding materials used in masonry, surfacing, and plastering that harden in place and are used to bind together bricks or stones. The mortar is preferably made of cement, plastic, resin or any other suitable mortaring material.

Figure 6:
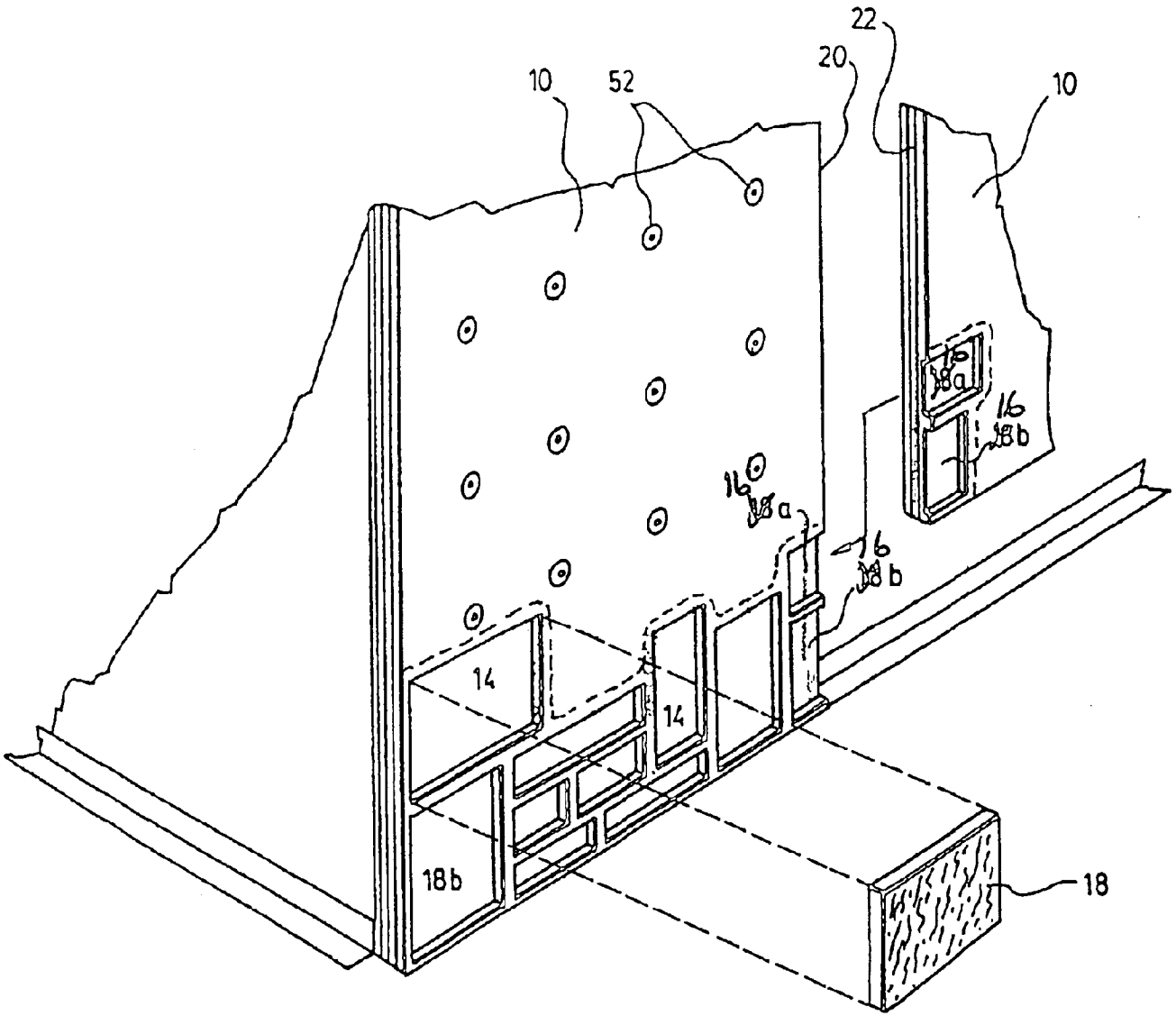
FIG. 6 is a perspective view showing a section of a wall where a panel of a set of panels according to a third preferred embodiment is installed and another panel of the set is about to be installed.

Referring now to FIGS. 4, 5 and 6, other aspects of the panel and the system according to a preferred embodiment will be described. The panels (10) are preferably mechanically secured to the building structure (50) by various means including but not limited to screws (52) or bolts.

The present invention also preferably provides anchoring means for anchoring the masonry work to the building structure (50). For this purpose, and referring to FIG. 4, the anchoring means comprise fasteners (54) including but not limited to screws, bolts and nails that are inserted into the ridges (32) of the panel (10) outlining the depressions (14,16). The fasteners (54) which comprise first and second opposed ends (56,58) are inserted into the ridges (32) such that the first end is anchored into the building structure (50) and the second end (58) is jutting out of the ridges (32). Therefore, when the pieces of masonry (18) are mortared together the projecting second ends (58) of the fasteners (54) are embedded within the mortar (60) and, as can be easily appreciated, when the mortar (60) hardens the masonry work becomes anchored to the building structure (50) by means of the fasteners (54).

Figure 10:
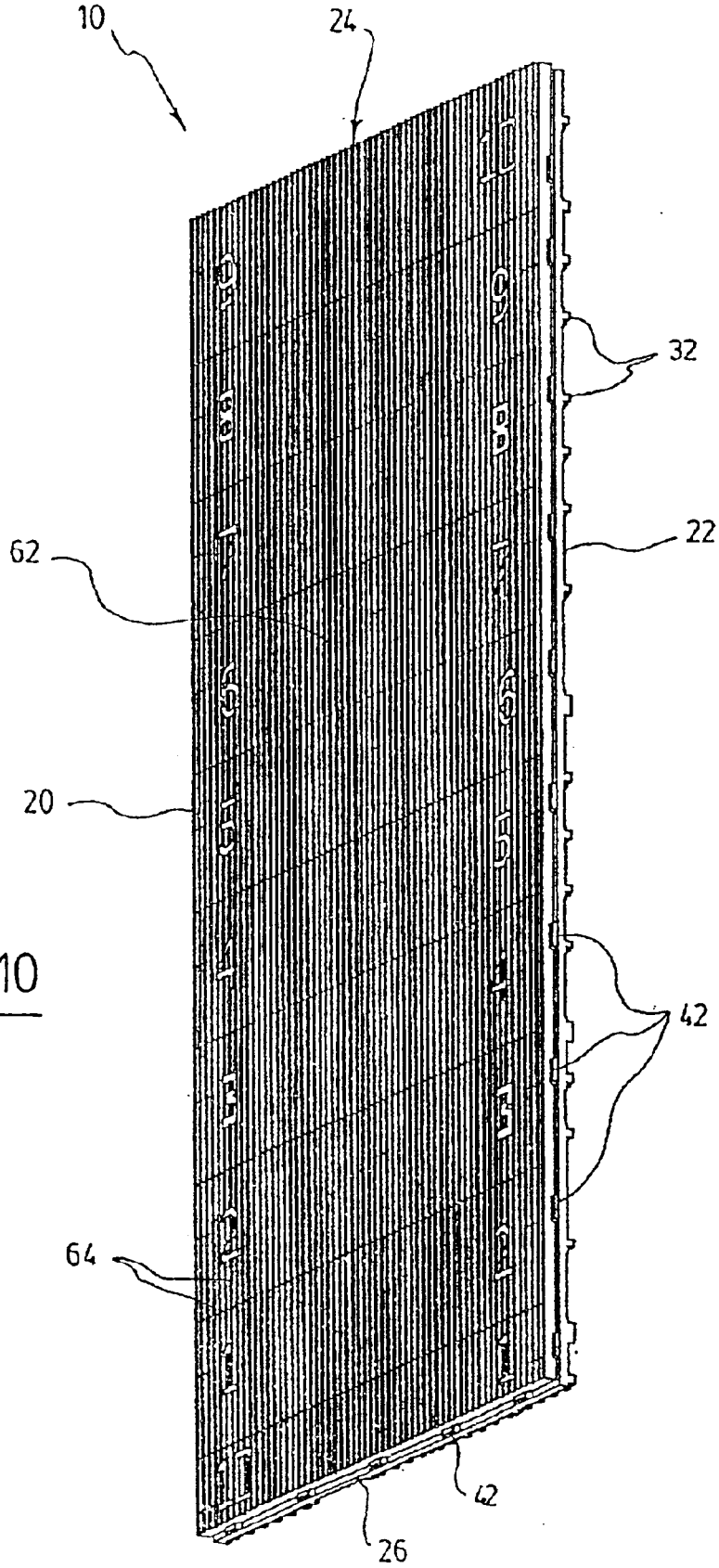
FIG. 10 is a back perspective view of the panel shown in FIG. 9.
Figure 11:
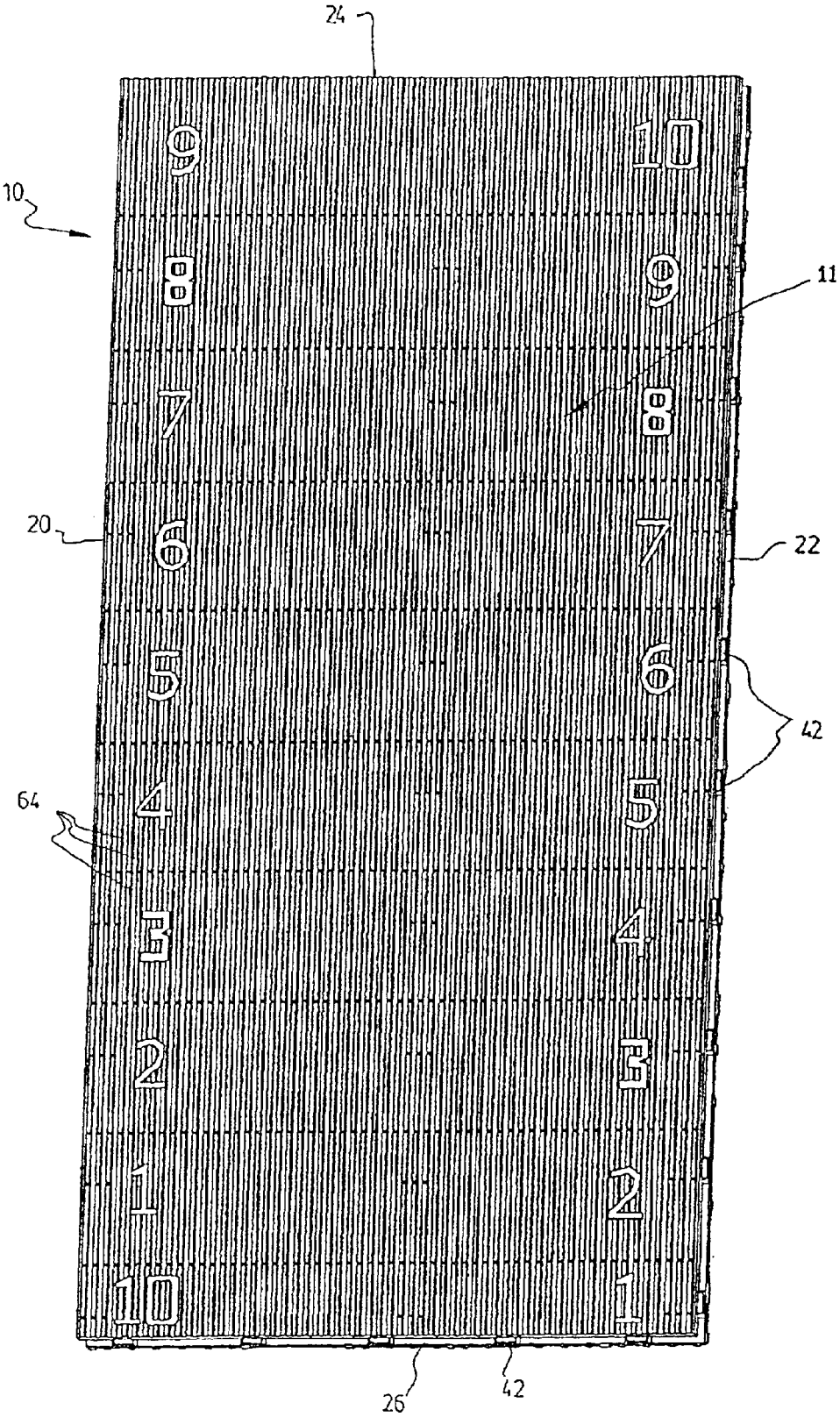
FIG. 11 is a back view of the panel shown in FIG. 9.

Referring to FIGS. 10 and 11, the back face (11) of the panel (10) preferably comprises draining means for draining water seeping between the panel (10) and the building surface (48). The draining means of the back face (62) preferably comprises bulges used for spacing the back face (11) from the building surface (48).

The bulges are preferably obtained by corrugating the back face (11) of the panel (10) and thereby forming elongated parallel protruding stripes (64). Preferably, the spacing between two adjacent stripes is chosen so as to prevent a capillary effect. More preferably the spacing is at least 6 mm.

Referring to FIGS. 6 to 8, the construction of a masonry wall using a set of five different panels (10) according to the invention is illustrated.

FIG. 6 is an isometric view showing a section of a wall where a panel (10) of molded Styrofoam is installed and another panel (10) of molded Styrofoam is about to be installed so that right edge (20) will join with left edge (22), and so that an individual stone (18) can overlap the joint between both panels of molded Styrofoam. The panels (10) of molded Styrofoam are mechanically attached to the wall by various means including but not limited to screws or bolts. A series of patterns (14,16) are traced into each panel (10) of the molded Styrofoam in something resembling a bas-relief. These traces or patterns can be created during the manufacturing process so that they are in fact molded into each of the molded Styrofoam panels (10). After the panels (10) of molded Styrofoam are attached, a mixture of adhesive cement is preferably applied into each of the patterns and then, a stone is pressed in.

FIG. 7 is an isometric view showing a section of a wall with two panels (10) of molded Styrofoam installed and some of the stones (18) installed. In this particular case, the left edge (22) of the molded Styrofoam panel (10) has been manually cut-out in such a way as to receive "French corners" (not shown) that take care of the corners of the walls. Some of the stones are laid to overlap the joint between two panels (10) of molded Styrofoam.

FIG. 8 is a front elevation of a house with repeating sequences of panels (10) of molded Styrofoam. In this example, with a set of only five molded Styrofoam panel (10), the distance between repeating patterns is so big plus the fact that windows and doorways cut into the patterns makes it virtually impossible for anyone to see repetition.

Another object of the present invention is to propose a method for forming a masonry wall on a building surface and insulating the same. Referring to FIGS. 3 to 5, the method comprises the steps of: a) mounting side by side on the building surface (48) a plurality of panels (10) as described above so that the second depressions (16) of each panel (10) are mated with their corresponding second depressions (16) from an adjacent panel (10); b) inserting in each of the first and second depressions (14,16) a piece of masonry (18) as a whole; and then c) mortaring the pieces of masonry (18).

Preferably, step a) of mounting comprises the step of securing each panel (10) to the building surface (48). For example, the panels (10) could be secured by screwing, bonding or any other suitable manner.

Also preferably, the method comprises the step of anchoring the mortared pieces (18) of masonry to the building surface (48). This step of anchoring preferably comprises the step of inserting a fastener (54) including first and second opposite (56, 58) ends through a number of the ridges (32) outlining the depressions (14,16) such that the first end (56) of each fastener (54) is anchored into the building surface (48) and the second end (58) is jutting out of the respective ridge (32) thereby causing the second end (58) to be covered with mortar (60) in the mortaring step c).

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

What is claimed is:

1. A panel for forming a masonry wall on a building surface, said panel comprising:

a back face for covering the building surface such that upon formation of said wall on said building structure, said back face becomes permanently secured thereto, opposite edges; and a front face with a predetermined pattern of first and second depressions, the first depressions being shaped and sized for receiving masonry piece as a whole whereas the second depressions, which intersect the opposite edges, are shaped and sized for receiving parts of masonry pieces, so that, when said panel is mounted side by side with a complementary panel, some masonry pieces bridge both panels by means of said second depressions and a retainer to retain the pieces of masonry within the first and second depressions.

2. A panel as claimed in claim 1, wherein the opposite edges comprise a right edge and a left edge, each of the second depressions intersecting the right edge being complementary with a corresponding one of said second depressions intersecting the left edge so that when said panel is mounted side by side with another like panel, some masonry pieces bridge the left and right edges of the panels by means of said second depressions intersecting the left and right edges.

3. A panel as claimed in claim 2, wherein the opposite edges comprise a top edge and a bottom edges, each of the second depressions intersecting the top edge being complementary with a corresponding one of said second depressions intersecting the bottom edge, so that when said panel is mounted on top or underneath another like panel, some masonry pieces bridge the top and bottom edges of the panels by means of said second depressions intersecting the top and bottom edges.

4. A panel as claimed in claim 2, wherein the second depressions are positioned along the right edge and the left edge of the panel such that the right edge or the left edge of said panel are matable with the left edge or the right edge respectively of said another like panel as the bottom edge of said another like panel is set out of line with the bottom edge of said panel.

5. A panel as claimed in claim 4, having a given height (h), in inches, from the bottom edge to the top edge and wherein the second depressions are positioned along the right edge and the left edge of the panel such that the right edge or the left edge of said panel are matable with the left edge or right edge respectively of said another like panel as the bottom edge of said another like panel is set at more than 0 inch to h/2 inches over or below the bottom edge of said panel.

6. A panel as claimed in claim 1, wherein the first and second depressions have a depth predetermined in function of the thickness of the masonry pieces to be received that is less than said thickness so as to allow mortar to be applied between inserted masonry pieces.

7. A panel as claimed in claim 1, wherein the front face comprises ridges outlining the first and second depressions and the retainer comprises projections made of a resilient material projecting from at least one of said ridges.

8. A panel as claimed in claim 7, wherein the projections are projecting from a top ridge of each depression.

9. A panel for forming a masonry wall on a building surface, said panel comprising:

a back face for covering the building surface such that upon formation of said wall on said building structure, said back face becomes permanently secured thereto;

opposite edges defining a right edge and a left edge;

a front face with a predetermined pattern of first and second depressions, the first depressions being shaped and sized for receiving masonry pieces as a whole whereas the second depressions, which intersect the opposite edges, are shaped and sized for receiving parts of masonry piece, so that, when said panel is mounted side by side with a complementary panel, some masonry pieces bridge both panels by means of said second depressions each of the second depressions intersecting the right edge being complementary with a corresponding one of said second depressions intersecting the left edge so that when said panel is mounted side by side with another like panel, some masonry pieces bridge the left and right edges of the panels by means of said second depressions intersecting the left and right edges; and draining means for draining liquid seeping between installed pieces of masonry and the panel.

10. A panel as claimed in claim 9, wherein the draining means comprises at least one groove formed in a bottom face of said first and second depressions and at least one cut in said ridges, said at least one groove and cut extending in a direction allowing a liquid seeping between installed pieces of masonry and the panel to flow downwards into the grooves and the cuts, when the panel is mounted on a building surface.

11. A panel as claimed in claim 2, comprising a reference mark to guide the mounting of said panel side by side with said another like panel so that the complementary second depressions match each other.

12. A panel as claimed in claim 11, wherein the reference mark comprises male and female members provided on either the right and left edges of the panel, adapted to fit together with female and male members of said another like panel.

13. A panel as claimed in claim 1, wherein the panel is made of an insulating material.

14. A panel as claimed in claim 13, wherein the insulating material is a foam.

15. A panel as claimed in claim 14, wherein the panel is rectangular.

16. A panel as claimed in claim 1, wherein the depressions have a symmetrical or irregular shape.

17. A panel as claimed in claim 16, wherein the depressions have a rectangular shape.

18. A method for forming a masonry wall on a building surface, the method comprising the steps of:

a) permanently mounting side by side on said building surface a plurality of panels, each panel comprising:
a back face mounted so as to cover the building surface, opposite, right and left edges and;
a front face with a predetermined pattern of first and second depressions, the first depressions being shaped and sized for receiving masonry pieces as a whole whereas the second depressions intersect the right and left edges such that a select second depression along the right edge is complementary with a corresponding one of said second depressions intersecting the left edge, wherein said plurality of panels are mounted such that the second depressions of each panel are mated with their corresponding second depressions from an adjacent panel; and a retainer to retain the masonry pieces within the first and second depressions.

b) inserting in each of the first and second depressions a piece of masonry as a whole; and c) mortaring the pieces of masonry.

19. A method as claimed in claim 18, wherein step a) of mounting comprises the step of;

securing each panel to the building surface.

20. A method as claimed in claim 19, comprising the step of anchoring the mortared pieces of masonry to the building surface.

21. A method as claimed in claim 20, wherein the panels comprise ridges outlining the first and second depressions and wherein the step of anchoring comprises, prior to step c) of mortaring, the step of:

inserting a fastener including first and second opposite ends through a number of said ridges such that said first end of each fastener is anchored into the building surface and the second end is jutting out of the respective ridge thereby causing the second end to be covered with mortar in step c).

22. A kit for forming a masonry wall on a building structure, comprising:

a set of masonry pieces, each masonry piece having a given shape and size; and a set of panels, each panel of the set comprising:
a back face for covering a building surface such that upon formation of said wall on said building structure, said back face becomes permanently secured thereto.
opposite edges and;
a front face with a predetermined pattern of first and second depressions, the first depressions being shaped and sized for receiving masonry pieces as a whole whereas the second depressions, which intersect the opposite edges, are shaped and sized for receiving parts of masonry pieces, so that, when said panel is mounted side by side with a complementary panel, some masonry pieces bridge both panels by means of said second depressions, said set of panels each further having at least one complementary panel in the set so that when a panel of the set is mounted side by side with its complementary panel, some masonry pieces bridge both panels by means of the second depressions and a retainer to retain the pieces of masonry with the first and second depressions.

23. A kit am claimed in claim 22, comprising:

a set of screws for screwing the panels to the building structure.

24. A kit as claimed in claim 23, comprising:

an amount of mortar for mortaring the masonry pieces.

25. A kit as claimed in claim 22, wherein the opposite edges of each panel comprise a right edge and a left edge, and all the peach of the set are identical whereby each of the second depressions intersecting the right edge of a first panel of the set is complementary with a corresponding one of said second depressions intersecting the left edge of said first panel so that when any one of said panels of the set is mounted side by side with another panel of the set, some masonry pieces bridge the left and right edges of the panels by means of said second depressions intersecting the left and right edges.

26. A kit as claimed in claim 25, wherein the opposite edges of the panels comprise a top edge and a bottom edge, each of the second depressions intersecting the top edge of said first panel being complementary with a corresponding one of said second depressions intersecting the bottom edge of said first panel, so that when any one of the panel of the set is mounted on top or underneath another panel of the set, some masonry pieces bridge the top and bottom edges of the panels by means of said second depressions intersecting the top and bottom edges.

* * * * *

UNITED STATES PATENT AND TRADEMARK OFFICE

CERTIFICATE OF CORRECTION

PATENT NO. : 6,857,248 B2
DATED : February 22, 2005
INVENTOR(S) : Ouellet et al.

It is certified that error appears in the above-identified patent and that said Letters Patent is hereby corrected as shown below:

Title page,
Item [73], Assignee, "Les Materiaux de'Construction Oldcastle Canada Inc., St. John-NB (CA)" should read -- Les Materiaux de Construction Oldcastle Canada Inc., St. John - NB (CA) --;

Column 7,
Line 37, "is believed to be adequate size if the panel (10) is used for" should read -- is believed to be an adequate size if the panel (10) is used for --;
Line 40, "predetenmined shapes and sizes adapted to receive rectan-" should read -- predetermined shapes and sizes adapted to receive rectan --;
Line 49, "cmx28.63 cm); (8.76 cmx28.52 cm); --;

Column 10,
Line 2, "edges comprise a top edge and a bottom edges, each of the" should read -- edges comprise a top edge and a bottom edge, each of the --;

Column 11,
Line 43, "mounting comprises the step of;" should read -- mounting comprises the step of; --;

Column 12,
Line 29, "23. A kit am claimed in claim 22, comprising:" should read -- 23. A kit as claimed in claim 22, comprising: --; and
Line 36, "and all the peach of the set are identical whereby each of the" should read -- and all the panels of the set are identical whereby each of the --.

Signed and Sealed this

Seventh Day of June, 2005

JON W. DUDAS
*Director of the United States Patent and Trademark Office*

UNITED STATES PATENT AND TRADEMARK OFFICE

CERTIFICATE OF CORRECTION

PATENT NO. : 6,857,248 B2
DATED : February 22, 2005
INVENTOR(S) : Ouellet et al.

It is certified that error appears in the above-identified patent and that said Letters Patent is hereby corrected as shown below:

Column 10,
Line 47, "of masonry piece, so that, when said panel is mounted" should read -- of masonry pieces, so that, when said panel is mounted --.

Signed and Sealed this

Sixth Day of September, 2005

JON W. DUDAS
*Director of the United States Patent and Trademark Office*